United States Patent [19]

Stanton

[11] 4,346,620

[45] Aug. 31, 1982

[54] SHOCK ABSORBING MEANS FOR A ROCKER ARM TYPE OIL WELL PUMP

[75] Inventor: George E. Stanton, Orient, Ohio

[73] Assignee: Nujack Oil Pump Company, Columbus, Ohio

[21] Appl. No.: 156,780

[22] Filed: Jun. 5, 1980

[51] Int. Cl.[3] ..... F16H 21/32

[52] U.S. Cl. ..... 74/583; 74/41; 60/369; 417/399

[58] Field of Search ..... 74/581, 582, 583, 41

[56] References Cited

U.S. PATENT DOCUMENTS

| | | | |
|---|---|---|---|
| 364,423 | 6/1887 | Loomis | 74/581 |
| 739,992 | 9/1903 | Davidson et al. | 74/581 X |
| 852,061 | 4/1907 | Hoffman . | |
| 1,607,239 | 11/1926 | Clapp . | |
| 2,204,725 | 6/1940 | Crites | 74/581 |
| 2,237,303 | 4/1941 | Calhoun | 74/583 |
| 2,681,623 | 6/1954 | Kane . | |
| 2,683,424 | 7/1954 | Kane . | |
| 3,103,131 | 9/1963 | Banek | 74/583 |
| 3,153,387 | 10/1964 | Sadouet . | |
| 3,158,048 | 11/1964 | Bollar . | |
| 3,606,797 | 9/1971 | Browning, Jr. | 74/41 X |
| 3,782,117 | 1/1974 | James . | |
| 3,797,366 | 7/1972 | Hanes et al. . | |
| 4,049,365 | 9/1977 | Sparks, Sr. . | |
| 4,147,477 | 4/1979 | Chardonneav . | |
| 4,161,137 | 7/1979 | Gaddy . | |
| 4,187,680 | 2/1980 | Sanford | 60/369 |

*Primary Examiner*—Leonard E. Smith
*Attorney, Agent, or Firm*—Millard & Cox

[57] ABSTRACT

Apparatus for pumping oil from a well includes a hydraulic pump for reciprocating a sucker rod string. A counterweight is connected to the sucker rod string by a chain strung over sprockets within a compact framework. The hydraulic pump applies a shock absorbing back pressure to the sucker rod.

6 Claims, 12 Drawing Figures

FIG. 2
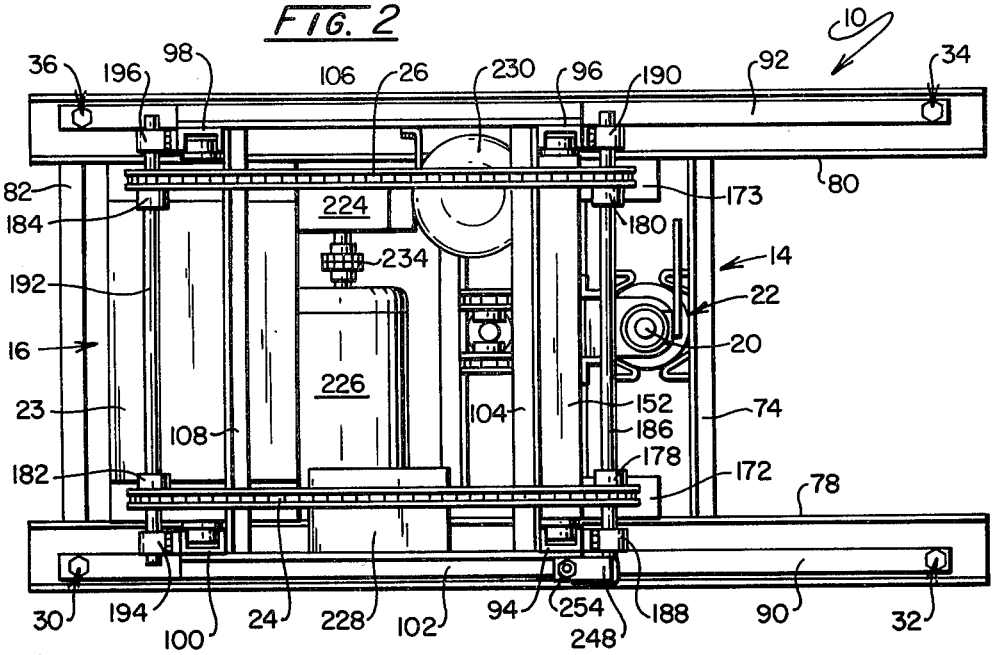
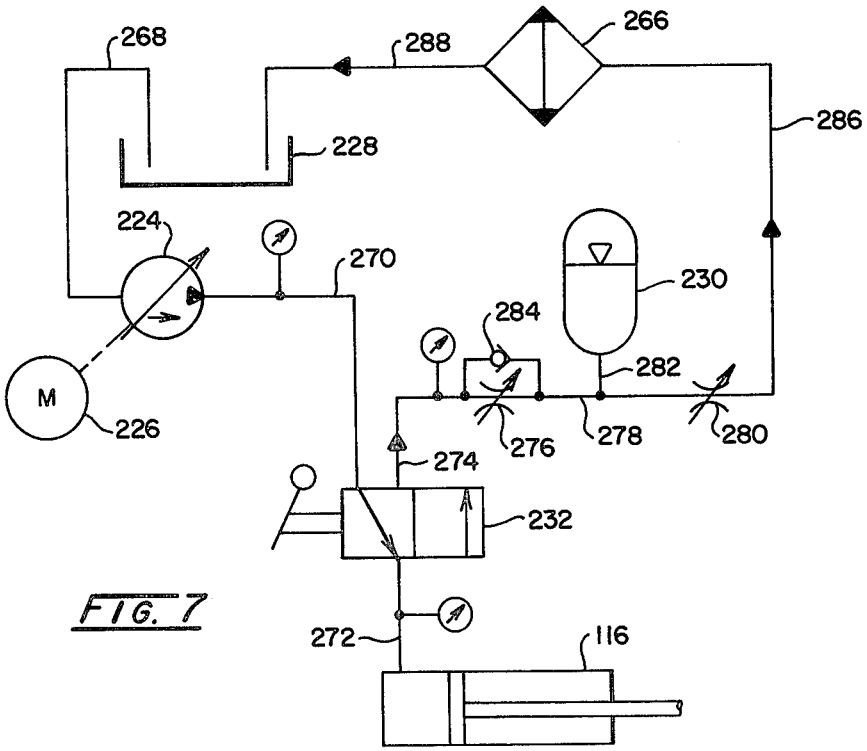
FIG. 7

98
96
26
10
192
184
194
108
106
104
180
186
190
230
238
240
236
24
16

200
222
210
128
130
124
122
138
142
168
134
144
140
162
14
173
12
18
116
170
226
152
148
150
118
120
146
166
20
36
86
34
86
92
82
110
227
112
114
84
80
56
40
56
56
58
58
58
76
22
54
54
54
52
50
48
72
74
66
68
64
38
28

96
94
180
186
178
106
102

254
248
258
26
24
250
256
138
14
136
174
174
12
176
176
252
264
260
158
154
262
164
170
152
232
162
233
160
166
156
36
34
86
86
92
152
90
78
20
78
56
56
60
60
58
58
54
22
54
46
48
76
28
72
64
62

FIG. 8
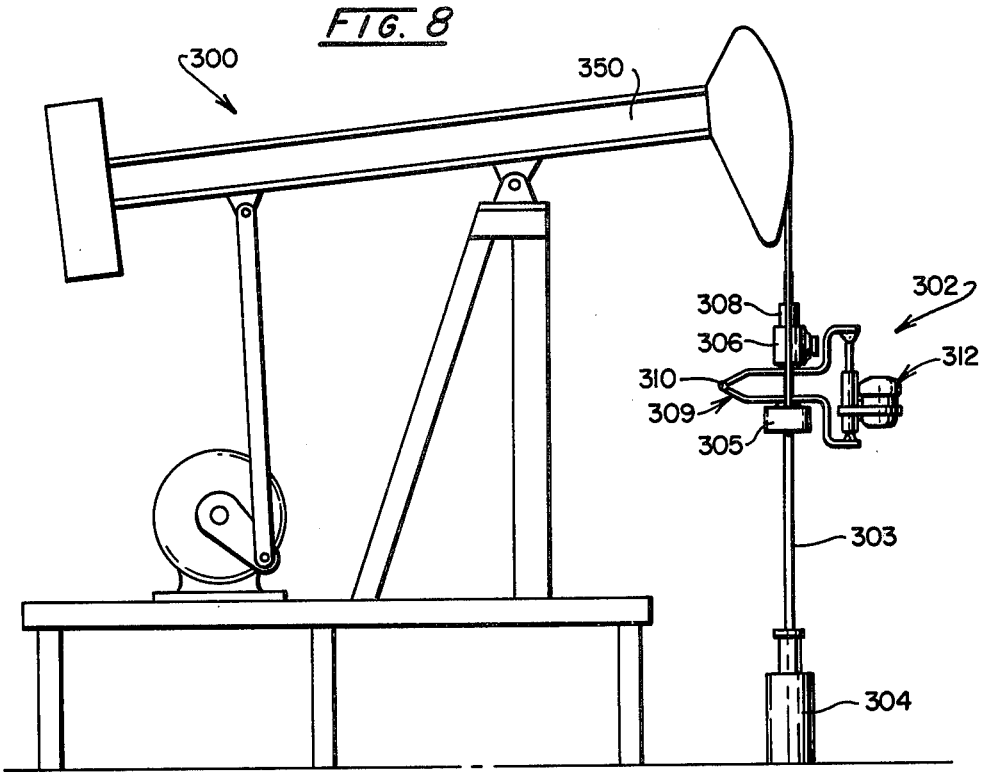
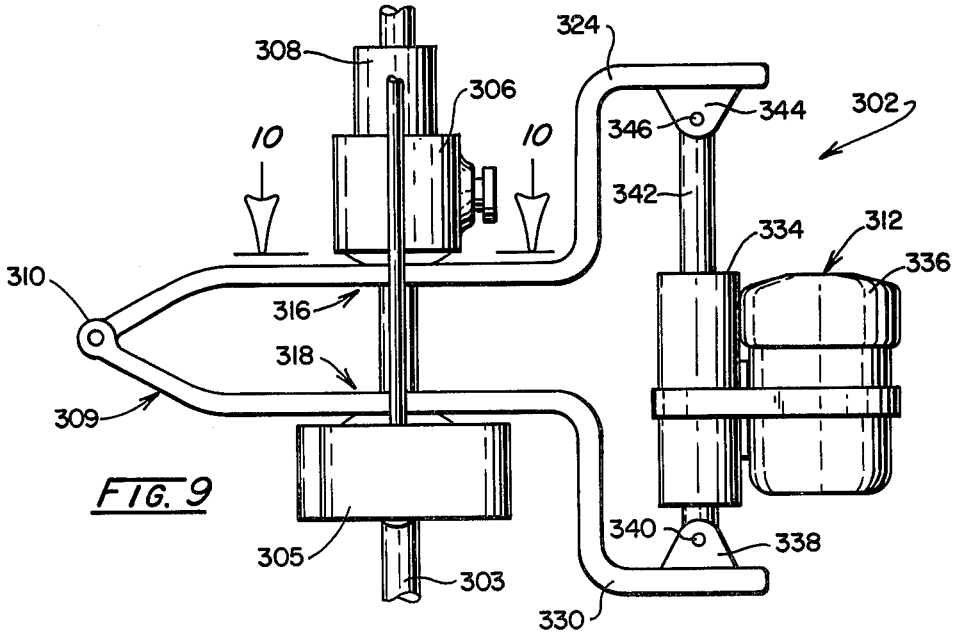
FIG. 9

FIG. 10
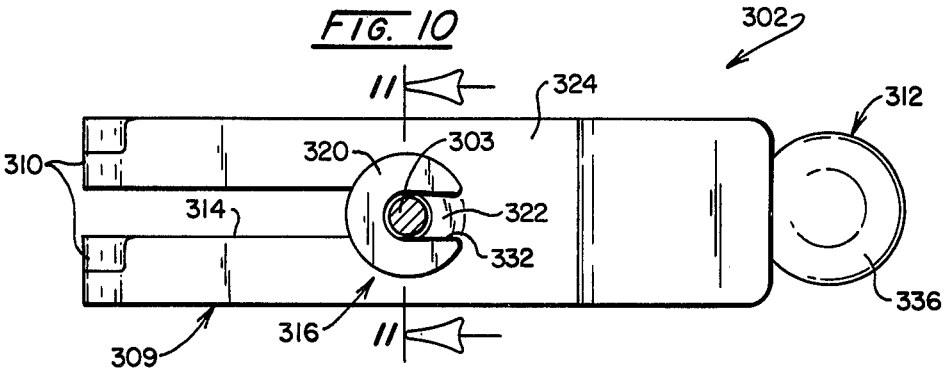
FIG. 11
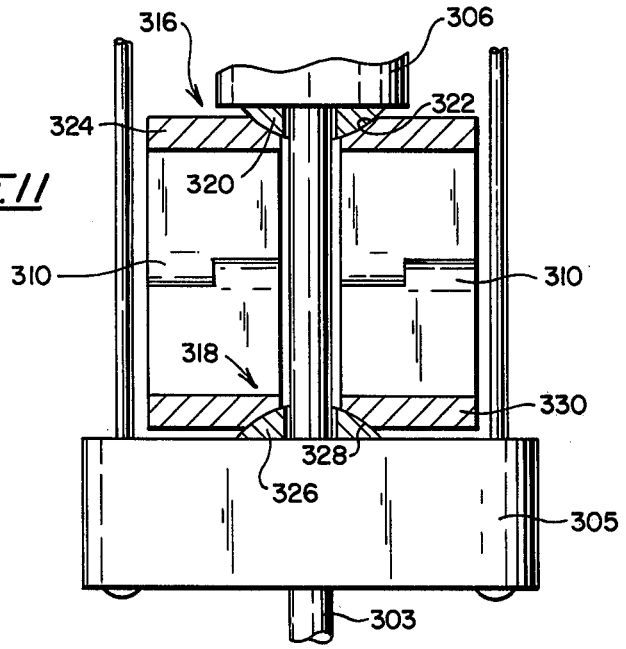
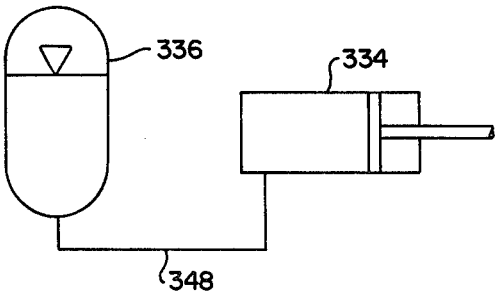
FIG. 12

SHOCK ABSORBING MEANS FOR A ROCKER ARM TYPE OIL WELL PUMP

BACKGROUND AND BRIEF DESCRIPTION OF THE INVENTION

Pumping units for oil and water wells often include a framework and a large counter-weighted rocker arm and are provided with various types of controls for reciprocating a sucker rod in the well. There are a number of problems with the conventional rocker arm structures among which are the size and weight of the pumping unit and the strain of impact on the sucker rods at the bottom of the downward stroke. A broken pumping string involves a great expense while a crew of men tries to fish the broken string out through the surrounding casing.

Where used herein, the phrase "oil well" may be considered to include water wells, gas wells and the like.

The present invention provides a compact pumping unit machine for reciprocating a sucker rod in an oil well and a hydraulic control unit which applies a shock absorbing means to a sucker rod at the bottom of its downward stroke. The pumping unit itself includes a compact framework and two opposed vertically, slideable carriages connected by a pair of chains. The chains are commonly connected by a pair of sprokets mounted on a common shaft. The front carriage is slideable within channels of the framework and is attached to the sucker rod. The rear carriage is slideable within other channels of the framework and carries a counter balance unit. Vertical reciprocation of the carriages is controlled by the hydraulic unit which lifts the sucker rod string by hydraulic pressure applied through a piston-cylinder combination. At the top of the stroke of the piston, the sucker rod begins its descent by gravity when the hydraulic fluid inflow to the cylinder ceases and a valve opens to allow the cylinder to drain.

A shock absorbing apparatus is incorporated into the drainage path which includes a pair of flow restriction valves, an accumulator tank between the valves and a pressure by-pass around the restriction valve nearest the cylinder in the flow path. The first restriction valve allows flow at a first rate while the downstream valve allows flow at a lower rate. Thus, excess hydraulic fluid will accumulate in the fluid-tight accumulator tank and the back pressure will build until it overcomes the check valve in the pressure by-pass line. The back pressure released through the check valve will slow the piston descent and thereby slow the descent of the sucker rod. The result is a cushioning or shock absorbing of the sucker rod as it nears the bottom and starts its upward stroke.

The present invention will be described with reference to a compact pumping unit which is especially useful in pumping oil. However, the compact pumping unit can also be used in pumping other fluids.

BRIEF DESCRIPTION OF THE DRAWINGS

The best mode contemplated in carrying out this invention is illustrated in the accompanying drawings in which:

FIG. 2 is a plan view of the pumping unit of FIG. 1;

FIG. 7 is a schematic view of the hydraulic control system;

FIG. 8 is a side elevational view of a rocker arm pumping unit and the well head having a shock absorbing unit attached thereto;

FIG. 9 is an enlarged section of FIG. 8 showing the shock absorbing hydraulic unit attached to the pumping unit of FIG. 8;

FIG. 10 is a horizontal sectional view taken along line 10—10 of FIG. 9;

FIG. 11 is a transverse sectional view taken along line 11—11 of FIG. 10; and FIG. 12 is a schematic view of the hydraulic system of the shock absorbing unit of FIG. 9.

DETAILED DESCRIPTION OF THE DRAWINGS

Figure 1:
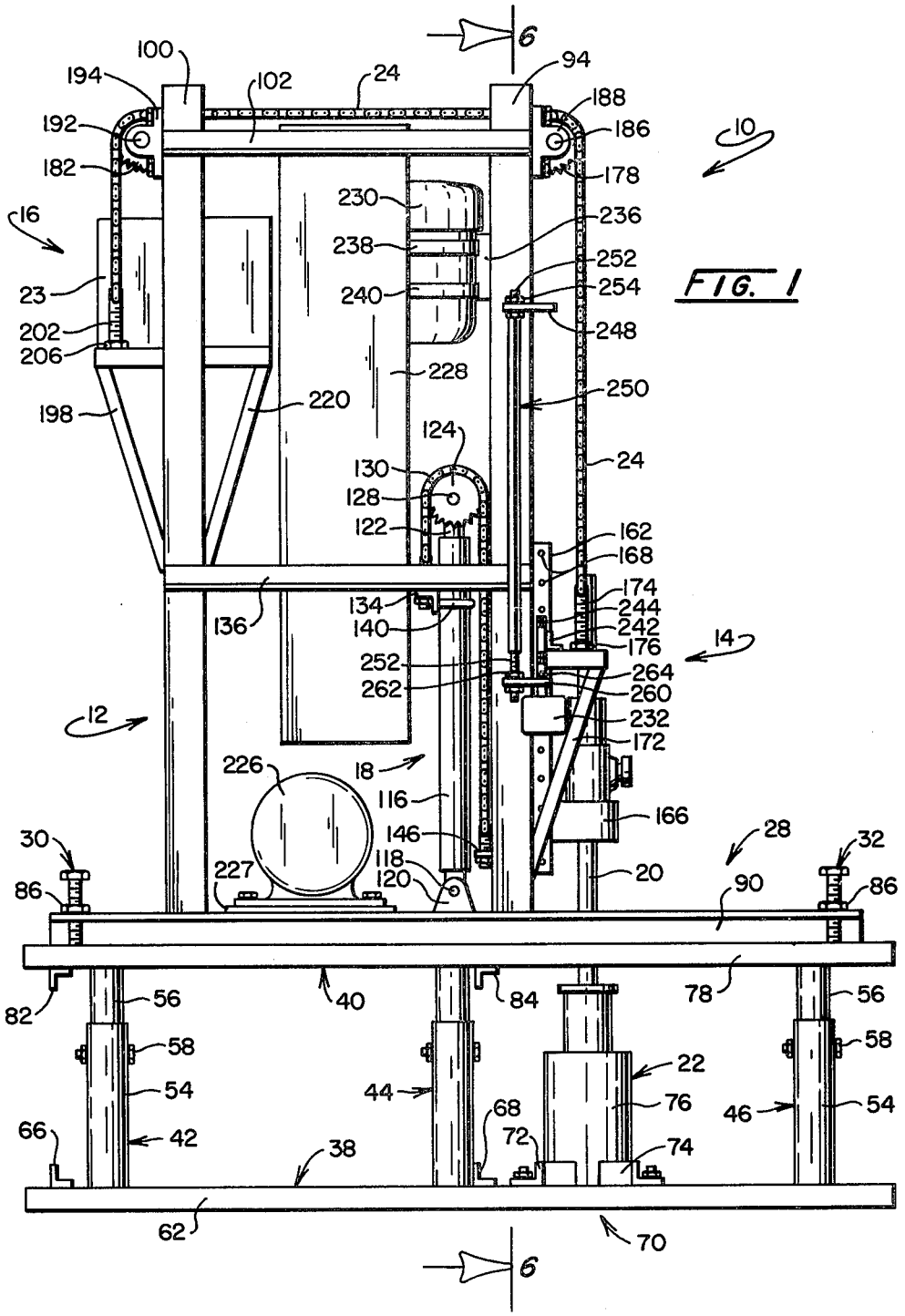
FIG. 1 is a side elevational view showing a compact pumping unit embodying this invention.

With specific reference to the drawings and particularly to FIGS. 1 through 4, a pumping unit 10 embodying this invention is shown and includes a framework 12, a pair of cooperating opposed vertically extending, slideably mounted carriage units 14 and 16 and a hydraulic control unit 18.

The front carriage unit 14 is shown as carrying a sucker rod 20 of an oil well 22 and the rear carriage unit 16 is shown carrying a counter weight 23. The front and rear carriage units are slideable within channels 90, 92, 94, and 96 of the framework 12 and the hydraulic control unit 18 is mounted in cooperation with the front carriage unit 14 to control the reciprocating action of the sucker rod 20. The rear carriage unit 16 is connected by a pair of chains 24 and 26 to the front carriage unit 14 and the rear carriage unit 16 carries the counterweight 23 which should correspond roughly to the weight of the sucker rod 20 for the most efficient operation. The weight of the sucker rod string will exceed that of the counterweight by a certain amount to allow the string to descend by gravity.

Pumping unit 10 is carried on a subframe 28 which supports the framework 12. Four leveling screws 30, 32, 34 and 36 are provided to allow proper adjustment of the framework 12 with respect to the subframe 28. It is desirable that the raising and lowering of the sucker rod 20 be coaxial with the well head 22 to minimize friction and binding and it is clear that the surface supporting the subframe will not always be perpendicular to that axis. Hence the leveling screws 30, 32, 34 and 36 will enhance the efficiency of the system when properly used.

The subframe includes a base 38 and a table 40 which are connected by six standards 42, 44, 46, 48, 50 and 52. Each standard includes an outer tube 54, an inner tube 56 and a bolt and nut arrangement 58. The inner tube 56 is slideably adjustable within the outer tube 54 and is secured at proper elevation by selecting the proper aperture correlation between the single aperture in tube 54 and the plural apertures 60 in inner tube 56.

The base 38 of subframe 28 includes two channels 62 and 64 which support the standards 42 through 52. Channel 62 is connected to channel 64 by angle braces 66 and 68 for stability. Diagonally disposed braces may be installed where a particularly rigid framework is desired. Also connected between channels 62 and 64 is a clamp 70 which consists of a pair of brackets 72 and 74 which engage a casing 76 at the well head 22.

The table 40 of the subframe 28 includes two vertical channels 78 and 80 vertically aligned with channels 62 and 64 and which are supported by the standards 42 through 52. Structural stability to channels 78 and 80 is supplied by a pair of angle braces 82 and 84. Standards 42 through 52 accommodate differences in well head heights and as described previously, screw levelers 30, 32, 34, and 36 provide a means for adjusting the channels 78 and 80 to a plane perpendicular to the axis of the well head. Once proper leveling and elevation are achieved, the screw levelers are locked in place by lock nuts 86 to prevent maladjustment due to subsequent vibration. The subframe 28 is held in place through the clamp 70 on the well head casing 76.

Channels 90 and 92 of frame 12 act as stabilizing feet and connect to vertically opposed channel slides 94 and 96 with vertically opposed channel slides 98 and 100. The vertically opposed channel slides 94, 96, 98 and 100 are connected together at the top by angle braces 102, 104, 106 and 108. The stabilizing base channels 90 and 92 are connected by angle braces 110, 112 and 114 near the lower ends of the channel slides 94, 96, 98 and 100. The angle braces 112 and 114 also support hydraulic cylinder 116 of the hydraulic control unit 18 as best shown in FIG. 5.

Figure 4:
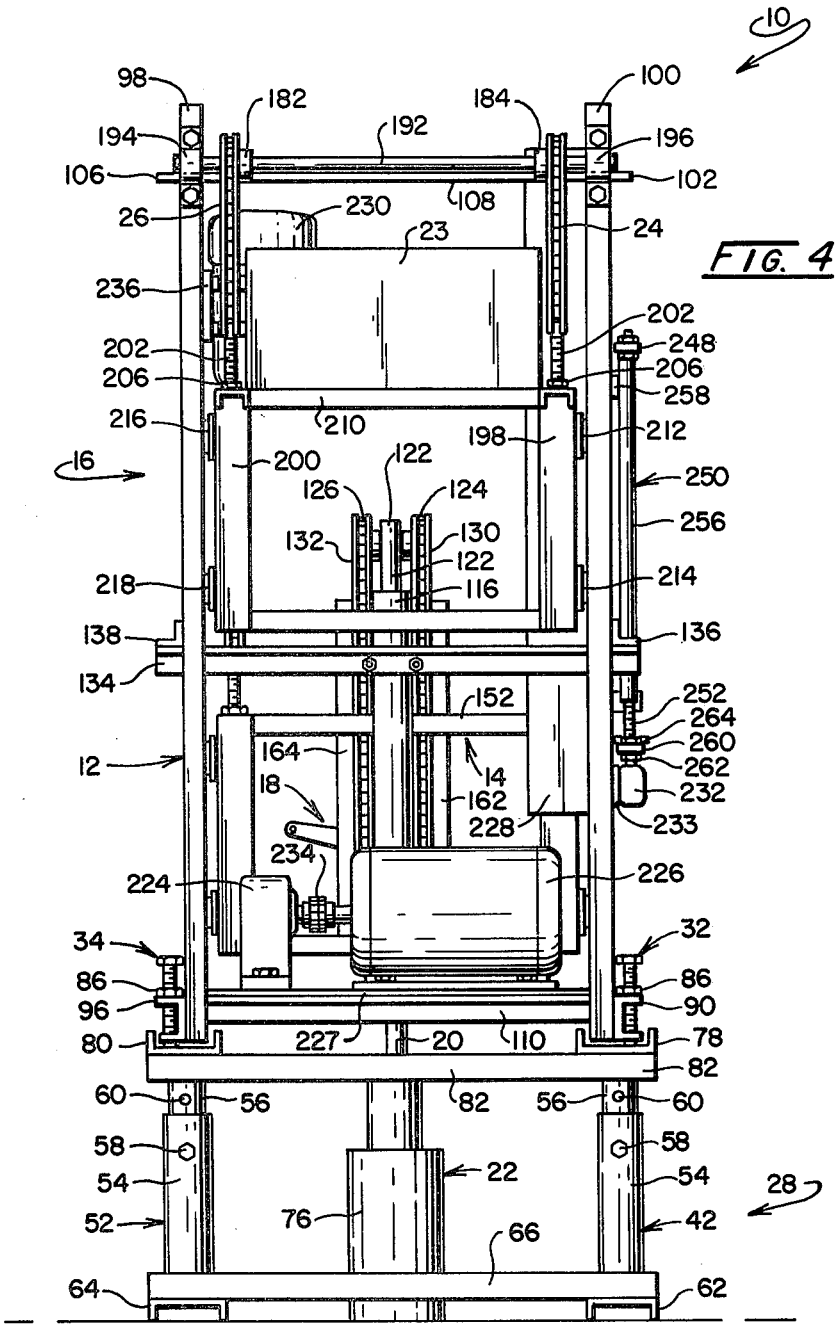
FIG. 4 is a rear elevational view of the pumping unit of FIG. 1.

Hydraulic cylinder 116 at its lower end is pivoted on a pin 118 connected to a bracket 120 which is welded to angle braces 112 and 114. A piston rod 122 projects from hydraulic cylinder 116 and is connected at its upper end to a pair of sprockets 124 and 126 through an axle 128 as best seen in FIGS. 4 and 5. A pair of chains 130 and 132 extending from an angle brace 134 engage the teeth of sprockets 124 and 126. The opposite ends of chains 130 and 132, in turn, connect to a pair of side angle braces 136 and 138 which are part of the framework 12. Hydraulic cylinder 116 is also secured to angle brace 134 by a U-bolt 140. Chains 130 and 132 are shown connected to angle brace 134 by means of threaded rods 142 and locking nuts 144.

Extending from angle brace 134, the chains 130 and 132 wrap around the sprockets 124 and 126 and then extend down to an angle bracket 146 which comprises the lower extension of the front carriage 14. Chains 130 and 132 are connected to the angle bracket 146 by means of threaded rods 148 and locking nuts 150 best shown in FIG. 5. This chain and sprocket system is used to accommodate a shorter stroke type of hydraulic cylinder to minimize the vertical extension of the pumping unit.

Figure 3:
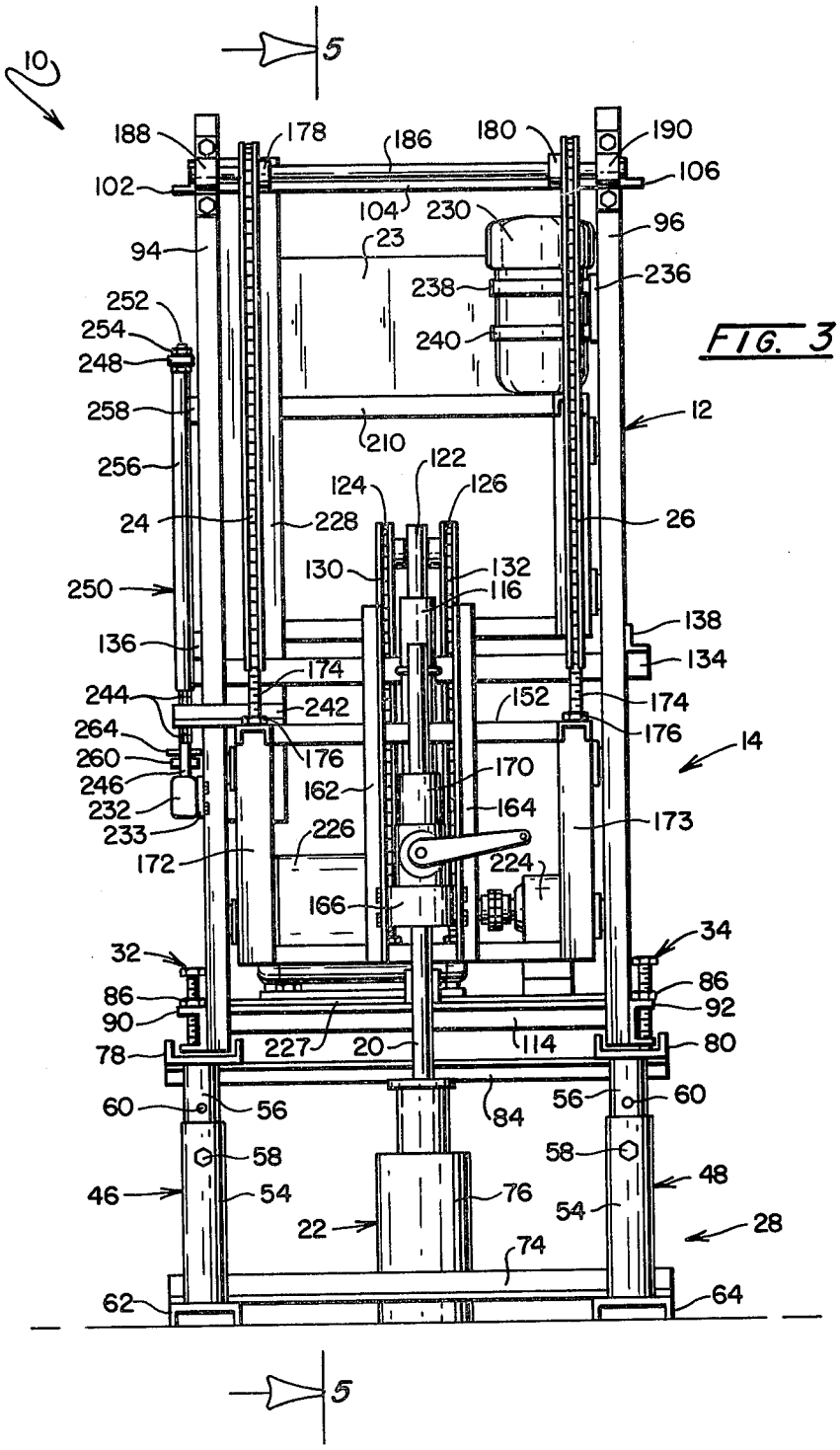
FIG. 3 is a front elevational view of the pumping unit of FIG. 1.
Figure 5:
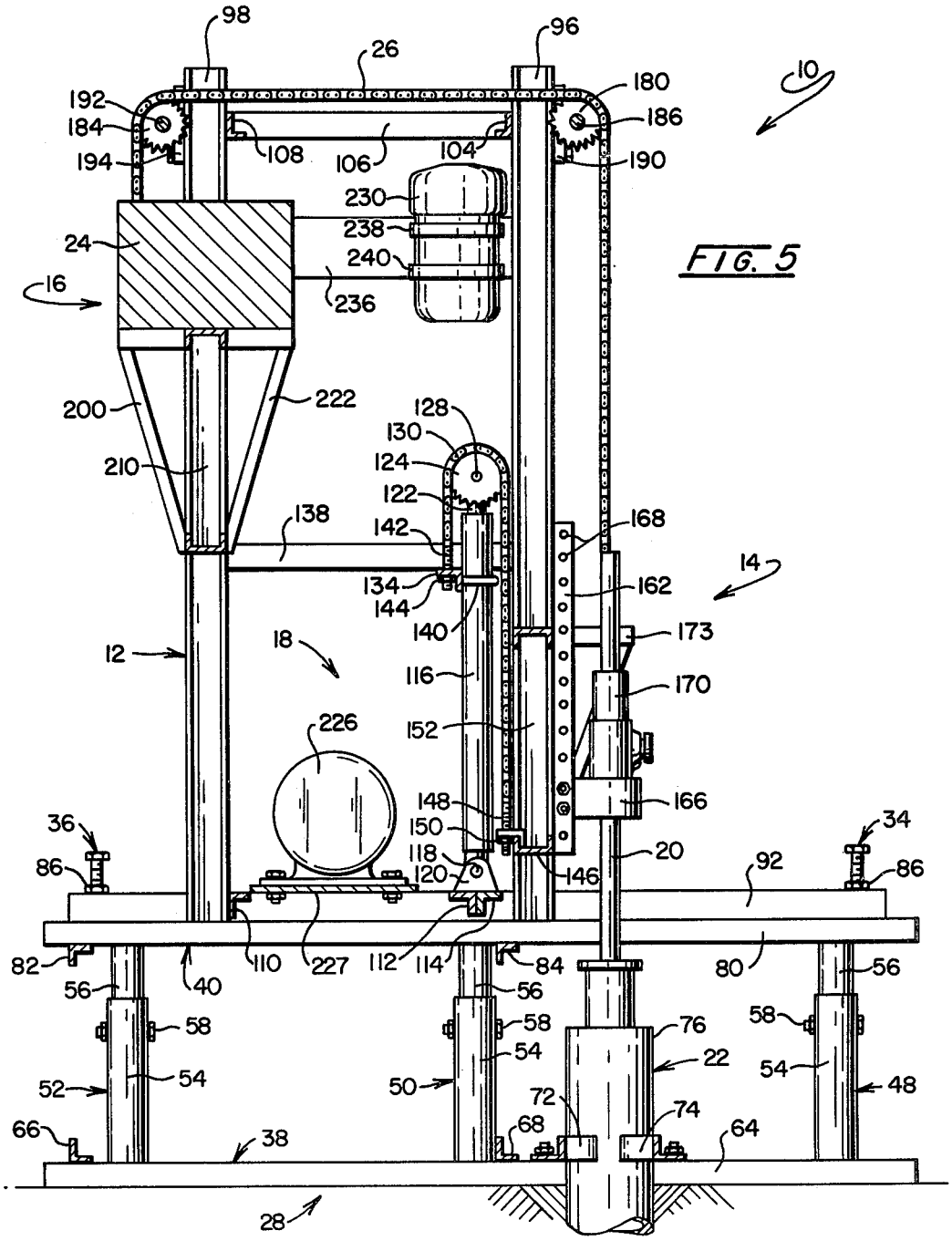
FIG. 5 is a vertical sectional view taken along line 5—5 of FIG. 3.
Figure 6:
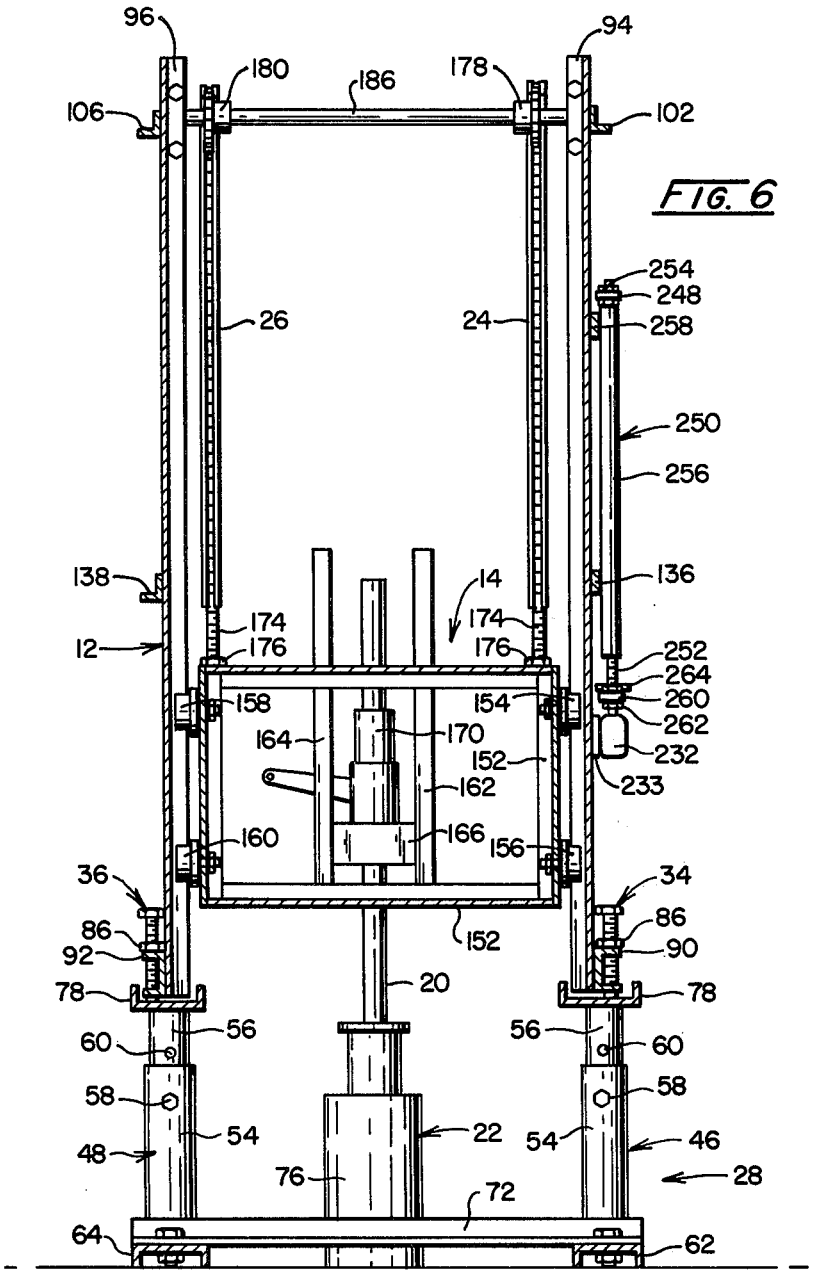
FIG. 6 is a vertical sectional view taken along line 6—6 of FIG. 1.

The angle bracket 146 is welded to rectangular frame 152 of the front carriage 14, seen in FIGS. 3, 5 and 6. The frame 152 carries on each of its sides roller wheels 154, 156, 158 and 160 which ride in the channel slides 94 and 96 allowing the front carriage 14 to be lifted by the hydraulic cylinder 116 in a vertical plane. A pair of angle brackets 162 and 164 are welded to the front of the frame 152 and connected to a sucker rod bracket 166. The bracket 166 is adjustable within the angle brackets 162 and 164 by means of holes 168 and is bolted thereto. The sucker rod 20 is connected to the bracket 166 by a sucker rod clamp 170 which is conventional and will not be described here. Extending forwardly from each side of the frame 152 of the front carriage 14 are a pair of chain retention brackets 172 and 173.

The chains 24 and 26 connect to brackets 172 and 173 by means of threaded rods 174 and are locked in place by a pair of locking nuts 176. Chains 24 and 26 extend upwardly over a pair of sprockets 178 and 180, then horizontally over a second pair of sprockets 182 and 184 and then downwardly to the rear carriage unit 16. The sprockets 178 and 180 are mounted on a common shaft 186 supported by pillow blocks 188 and 190 attached to the upper front face of channel slides 94 and 96. Sprockets 182 and 184 are also mounted on a common shaft 192 which is carried by pillow blocks 194 and 196 attached to the upper rear face of channel slides 98 and 100. The remote ends of chains 24 and 26 are attached to a pair of brackets 198 and 200 on the rear carriage 16 by means of threaded rods 202 and are locked in place by nuts 206.

The rear carriage 16 includes a rectangular frame 210 having roller wheels 212, 214, 216 and 218 disposed along its sides which ride in channel slides 98 and 100, best shown in FIG. 4. Welded to the rear of frame 210 are chain retention brackets 198 and 200. These brackets 198 and 200 also serve as part of a platform for the counterweight 23. Welded to the front of the frame 210 are a similar pair of platform brackets 220 and 222. The counterweight 23 of the rear carriage 16 can be interchanged with other weights to accommodate for different weights of sucker rods in conjunction with difference in well depths.

The hydraulic control unit 18 includes the hydraulic cylinder 116, a hydraulic pump 224 which is driven by motor 226, a reservoir 228, an accumulator 230 and a control valve 232 best shown in FIGS. 1 through 5. The hydraulic pump 224 is a variable displacement, pressure compensating type pump which is driven by the motor 226 through a flexible connector 234 best shown in FIG. 4. The motor 226 is shown as an electric motor but can be interchanged with other types of drive units which may be powered by gasoline, natural gas, diesel, etc. The pump 224 and motor 226 are mounted on a plate 227 which is welded to channels 90 and 92. The reservoir 228 which is a long thin tank and is so designed to provide a large surface area for a greater cooling effect is mounted on brackets 102 and 136 of framework 12. The accumulator 230 is so sized to accommodate the hydraulic cylinder 116. The accumulator 230 is mounted to a bracket 236 by a pair of straps 238 and 240. Bracket 236 is welded to channel slides 96 and 98 of framework 12. The control valve 232 being mounted on a bracket 233 is a three-way, two position, mechanically controlled hydraulic valve.

The control valve 232 is actuated by a front carriage 14 through a lever arm 242 welded to a chain retention bracket 174 of the frame 152. The lever 242 is adjustable through an adjuster 244 welded thereto. In the descent of the front carriage 14, the lever 242 contacts the top of the plunger 246 of valve 232, and in the ascent of the front carriage 14, the lever 242 contacts a lever 248 which functions as a plunger lifter unit 250.

The plunger lifter unit 250 includes lever 248 which is connected to a rod 252 by locking nuts 254. The rod 252 extends downwardly through a guide tube 256 which is welded to spacer 258 and angle bracket 136, best seen in FIG. 3. The other end of rod 252 is attached to a fork shaped lever 260. The fork shaped lever 260 is locked in place on rod 252 by locking nuts 262 best seen in FIGS. 1 and 4. The ends of rod 252 are threaded to allow adjustment of the pumping stroke of the sucker rod.

A fluid cooler 266, schematically illustrated in FIG. 7, can be added for additional cooling of the hydraulic fluid if desired. Also shown in FIG. 7 is a schematic of the hydraulic control unit 18 which is shown in the upward direction mode. This mode is when the lever 242 of the front carriage 14 has depressed plunger 246 of the control valve 232.

Starting the reservoir 228, of the schematic shown in FIG. 7, the suction line 268 carried fluid to the pump 224, driven by the motor 226, and then through a pressure line 270 to the control valve 232. The fluid then flows through a line 272 causing the hydraulic cylinder 116 to extend upward, thereby lifting the sucker rod through its connection with the front carriage 14. When the front carriage reaches the lever 248 of plunger lifter unit 250 it will lift the plunger and thereby reverse the flow in the control valve 232. By raising the plunger 246 the weight of the sucker rod forces fluid to flow out of cylinder 116, back through line 272 and the control valve 232 to line 274 and then through a variable fluid restriction valve 276.

The restriction valve 276 controls the rate of fall of the sucker rod. The fluid then flows from restriction valve 276 through line 278 to another variable restriction valve 280. This restriction valve 280 controls the rate of flow of fluid through line 282 into the accumulator 230. When the fluid tight (gas filled) accumulator 230 fills, the pressure in line 278 increases and overcomes the check valve 284 in the by-pass around valve 276. Thus, there is a back pressure buildup applied to line 274 which slows the fluid outflow from cylinder 116 causing the hydraulic cylinder 116 to slow its rate of retraction, thereby applying a shock absorbing action to the sucker rod 20. Further retraction of the hydraulic cylinder 116 is caused by the weight of the sucker rod 20 on the front carriage 14 but at a slower rate. The fluid then flows at the slower rate from the restriction valve 280 through line 286 to optional cooler 266 and then back to the reservoir 228 through line 288 and empties the accumulator 230 during the next upward stroke of the sucker rod.

In the operation of the machine, the sucker rod 20 is lifted by the front carriage unit 14. The front carriage 14 is lifted by the hydraulic cylinder 116 of the hydraulic control unit 18. The weight of the sucker rod 20 is partially balanced by the counterweight 23 of the rear carriage unit 16. The weight of the rear carriage unit 16 is transmitted to the front carriage unit 16 through the chains 24 and 26. When the sucker rod reaches the top of its upward stroke, the control valve 232 is actuated and the front carriage starts its descent due to the weight of the sucker rod 20. The downward stroke of the sucker rod 20 is slowed by the hydraulic control system 18 applying its shock absorbing means. When the sucker rod 20 reaches the bottom of its downward stroke the control valve is actuated and the pumping unit 10 cycles creating a reciprocating action to the sucker rod 20, thereby pumping oil from the well.

While it is not illustrated, it will be clear that another accumulator may be incorporated into the hydraulic discharge system to serve as a pressure reservoir to assist in the lifting of the pumping string 20 as it starts its ascent. This would increase the efficiency of the system but would also increase the cost of the pumping unit.

With specific reference to FIG. 8, an example of a conventional rocker arm pumping unit 300 is shown which incorporates a sucker rod shock absorbing unit 302 according to this invention. The shock absorbing unit 302 is attached to the sucker rod 303 of oil well 304 between the cable retention bracket 305 and the sucker rod rotator 306. A sucker rod clamp 308 holds the rotator 306 in place best shown in FIGS. 8 and 9.

The shock absorbing unit 302 is generally shaped like a pair of jaws. At one end of the jaws 309 is a pivot 310 and at the other end there is an accumulative hydraulic cylinder unit 312. A slot extending from the pivot end 310 accommodates the passage of the cable. The shock absorbing unit 302 is inserted between the cable retention bracket 305 and the sucker rod rotator 306 with the sucker rod within the slot 314 of the jaws 309 best shown in FIG. 9.

The jaws 309 are held in place straddling the cable by ball and socket units 316 and 318 best shown in FIGS. 9, 10 and 11. The ball and socket units 316 and 318 also serve as bearing surfaces when the jaws 309 are closed and opened. The ball and socket unit 316 includes a ball 320 and socket 322, which is part of the upper jaw 324, and the ball and socket unit 318 includes ball 326 and socket 328, which is part of the lower jaw 330, best shown in FIG. 11. The balls 320 and 326 are slotted to accommodate the sucker rod 303 best shown in FIG. 10. The balls 320 and 326 slide over the sucker rod, within the slots 332, in the opposite direction of the way the jaws were installed and are seated in the sockets 322 and 328 locking the shock absorbing unit 302 in place. It will be noted that the weight of the sucker rod is continuous.

The accumulative cylinder unit 312 includes a cylinder 334 and an accumulator 336. The cylinder 334 is attached at its base to a pivot 338 by a pin 340. A piston rod 342 extends from cylinder 334 and is connected to a pivot 344 by a pin 346.

The jaws 309 of the shock absorbing unit 302 are compressed when the downward force of the sucker rod 303 is greater than the force applied to the jaws 309 by the accumulative cylinder unit 312.

The cylinder 334 of the accumulative cylinder unit 312 is charged by the accumulator 336 shown schematically in FIG. 12 through line 348.

The jaws 309 of the sucker rod shock absorbing unit 302 are compressed only when the rocker arm 350 of the pumping unit 300 has completed its downward stroke and starts into its upward stroke. Without the shock absorbing unit 302, at this point of the rocker arm 350, the sucker rod 303 is stressed and can break, causing a great deal of expense in the recovery of the sucker rod from the oil well.

While two embodiments of this invention have been described and shown, it will be obvious that certain modifications may be made in the structure without departing from the spirit of the invention. Accordingly, it is not the intention of the inventor to limit the invention by the language used to describe the drawings. Rather it is the intention of the inventor to be limited only by the scope of the appended claims.

I claim:

1. A shock absorbing means for attachment to a rocker arm type well pumping apparatus, said shock absorbing means being attached to a sucker rod pumping string between a cable retention bracket and a sucker rod rotator;

the attachment including upper and lower jaws hinged at one side and having a coaxial piston and cylinder combination mounted between the jaws at the other side;

hydraulic fluid in the cylinder in contact with the piston and in fluid communication with a fluid-tight reservoir partially filled with hydraulic fluid.

2. A shock absorbing means according to claim 1 wherein a dish-shaped socket is provided on the exterior surface of each jaw.

3. A shock absorbing means according to claim 2 wherein the cable retention bracket and the sucker rod are provided with convex protrusions extending into engagement with said dish-shaped sockets.

4. In apparatus for pumping a liquid from a well comprising a pump jack having a rocker arm pivoted intermediate its ends and a sucker rod attached means mounted on one limb of said rocker arm;

the improvement which comprises a shock absorbing means connected between said sucker rod attachment means and said rocker arm, said shock absorbing means comprising upper and lower jaws, a hinge connected between said jaws, a hydraulic piston-and-cylinder combination spaced from said hinge and connecting said upper and lower jaws and a pressurized fluid tight accumulation tank in fluid communication with said piston-and-cylinder combination.

5. Apparatus according to claim 4 wherein a dish shaped socket is provided on the exterior surface of each of said jaws.

6. Apparatus according to claim 5 wherein said shock absorbing means is connected to said rocker arm and said sucker rod by a cable retention bracket and a sucker rod rotator respectively and said cable retention bracket and said sucker rod rotator each include a convex protrusion extending into engagement with the adjacent one of said dish shaped sockets.

* * * * *